US008979591B2

(12) United States Patent
Mehnert et al.

(10) Patent No.: US 8,979,591 B2
(45) Date of Patent: Mar. 17, 2015

(54) ROUND PLUG CONNECTOR WITH SHIELDED CONNECTION CABLE

(75) Inventors: Wolfgang Mehnert, Lindau (DE); Bernd Froese, Muhlheim An der Ruhr (DE)

(73) Assignee: IFM Electronic GmbH (DE)

( * ) Notice: Subject to any disclaimer, the term of this patent is extended or adjusted under 35 U.S.C. 154(b) by 0 days.

(21) Appl. No.: 14/126,953

(22) PCT Filed: Jul. 4, 2012

(86) PCT No.: PCT/EP2012/063062

§ 371 (c)(1), (2), (4) Date: Dec. 17, 2013

(87) PCT Pub. No.: WO2013/004761

PCT Pub. Date: Jan. 10, 2013

(65) Prior Publication Data

US 2014/0113488 A1 Apr. 24, 2014

(30) Foreign Application Priority Data

Jul. 4, 2011 (DE) ..... 10 2011 078 622

(51) Int. Cl.

| | |
|---|---|
| ***H01R 13/6592*** | (2011.01) |
| ***H01R 13/6581*** | (2011.01) |
| ***H01R 13/622*** | (2006.01) |
| ***H01R 13/71*** | (2006.01) |
| *H01R 13/639* | (2006.01) |
| *H01R 107/00* | (2006.01) |

(52) U.S. Cl.

CPC ..... *H01R 13/6581* (2013.01); *H01R 13/622* (2013.01); *H01R 13/71* (2013.01); *H01R 13/6592* (2013.01); *H01R 13/639* (2013.01); *H01R 2107/00* (2013.01)

USPC ..... 439/607.41

(58) Field of Classification Search

USPC ..... 439/95, 578, 582, 584, 607.41

See application file for complete search history.

(56) References Cited

U.S. PATENT DOCUMENTS

| | | | | |
|---|---|---|---|---|
| 6,566,767 | B1 | 5/2003 | Tardo | |
| 6,929,508 | B1 * | 8/2005 | Holland | 439/579 |
| 7,674,132 | B1 * | 3/2010 | Chen | 439/578 |
| 7,845,978 | B1 * | 12/2010 | Chen | 439/578 |
| 8,342,879 | B2 * | 1/2013 | Amidon et al. | 439/584 |
| 8,469,739 | B2 * | 6/2013 | Rodrigues et al. | 439/578 |
| 2008/0293298 | A1 * | 11/2008 | Burris et al. | 439/582 |
| 2010/0081321 | A1 * | 4/2010 | Malloy et al. | 439/578 |
| 2010/0233901 | A1 * | 9/2010 | Wild et al. | 439/578 |
| 2010/0297875 | A1 | 11/2010 | Purdy et al. | |
| 2011/0230091 | A1 * | 9/2011 | Krenceski et al. | 439/578 |

FOREIGN PATENT DOCUMENTS

DE 10 2009 001360 A1 9/2009

OTHER PUBLICATIONS

International Search Report—PCT/EP2012/063062—International File Date: Jul. 4, 2012; IFM Electronic GMBH; 2 pgs.

* cited by examiner

*Primary Examiner* — Alexander Gilman

(74) *Attorney, Agent, or Firm* — Schmeiser, Olsen & Watts, LLP

(57) ABSTRACT

In a round plug connector, the screen ends at the plug-side end of the grip body, is provided. An axially moveable contact-making element is arranged on a screw element, it being possible for the contact-making element to assume two positions. The first position is "screen applied". The second position is "screen not applied".

7 Claims, 9 Drawing Sheets

Female - Not Contacted

Female - Contacted

Female - Not Contacted

Male - Not Contacted

ROUND PLUG CONNECTOR WITH SHIELDED CONNECTION CABLE

FIELD OF TECHNOLOGY

The following relates to a round plug connector having a shielded connection.

BACKGROUND

Connection cables with standardized round plug connectors, e. g. straight or 90° angled M12, are frequently used in automation systems to connect sensors or actuators to control units or power supply units. The sensors or actuators are supplied via the connection cables, and analog switch signals and/or data are simultaneously transmitted. A screw element is used for securely connecting a round plug connector (male/female) to a matching counterpart piece, said screw element being either configured as a union nut (female) or as a shield sleeve (male). Undesired electromagnetic interferences like inductive proximity switches may lead to malfunctions in the system. Sensors may, for example, output false switching signals.

The interferences may be inductive, or capacitive, or galvanic interferences. In particular, significant interferences can occur in the proximity of powerful electric motors. In order to prevent the impairment of the individual components of a system due to electromagnetic interferences, shielded connection cables are frequently used which are significantly more expensive than unshielded cables.

The shielded connection cables normally have cable shields made of a non-magnetic material, like copper or aluminum. The cable shields frequently consist of braided individual shields which are composed of sets of wires that are interwoven in opposite directions. The density and thickness of the wire mesh essentially define the quality of the shielding.

The shielding is frequently only connected to ground (reference potential) at one end of the cable. In order to suppress magnetic interferences the shielding has to be connected to both ends of the cable. In such cases, however, there is the risk of a ground loop. Ground loops occur, in particular, when two points of the grounding are connected to one another via different electrically conductive paths. The ground connection, in this case, is a closed loop. In certain circumstances ground loops can cause very high currents to develop on the shielding which contribute to interferences in the signal lines. Two grounding concepts have become established in the industrial sector. In the tree structure, all ground connections are routed separately to a defined collection point. In the mesh structure, there are several grounding points which are connected to one another. The individual shielding concepts have been optimized for specific interferences.

In order to realize different shielding concepts, different cable versions are offered by the providers of shielded connection cables. In a first version, the shield is not connected. In a second cable version, the shield is connected to both sides, i.e. the respective union nut or shield sleeve of the round plug connector is connected to the reference potential. In a third version, the shield is connected, and additionally connected to pin 5 of the round plug connector.

When planning a system, the user has to decide on a specific shielding concept and then wire the individual components of the system to one another accordingly. Only on starting up a system, will it become apparent if the selected shielding concept will actually have the desired success. If the functionality of the system is still impaired by electromagnetic interferences, the wiring will have to be replaced in an expensive and time-consuming manner, or other cost-intensive measures will have to be taken in order to eliminate the interferences.

SUMMARY

An aspect relates to a round plug connector with shielded connection cables which can be used for different shielding concepts, which is suitable for a straight as well as an angled plug version, and which can be cost-effectively and easily manufactured, and should only result in minor modifications of available round plug connectors.

The basic concept of the invention in a round plug connector with shielded connection cables consists in that the shielding is made to end on the anterior border of the grip body (insulator), and that a movable conductive contacting element is provided which, in a first position, is only connected electrically conductive to the union nut and, in a second position, establishes an electrically conductive connection between the shielding and the screw element.

As a result, the shielding concept can be easily varied by means of the movable contacting element at the individual round plug connectors when operating the system by selecting between both "shield connected" or "shield not connected" modes, so that the impairment of the system due to interferences is prevented as best as possible.

The invention will hereinafter be explained in more detail by means of different exemplary embodiments.

BRIEF DESCRIPTION

Shown are:

DETAILED DESCRIPTION

Figure 1:
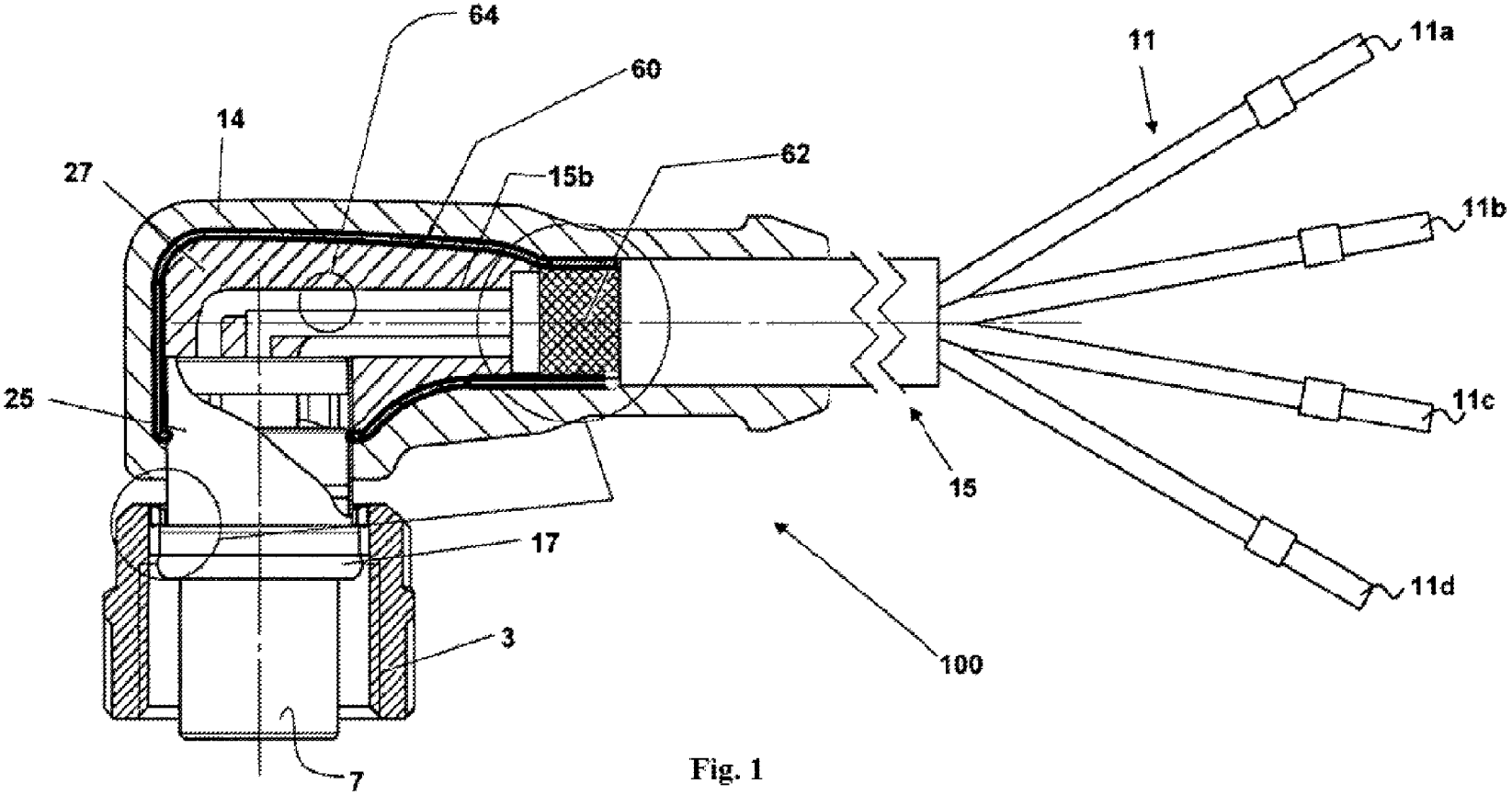
FIG. 1 depicts a cross-sectional view of a round plug connector (angled) with shielded connection cables according to the prior art.

FIG. 1 shows a conventional M12 round plug connector 100 of an angled shape with a multicore shielded connection cable 11. The cores 11*a*, 11*b*, 11*c*, 11*d* of the connection cable 11 consist of one core insulation 12*a*-12*d* each, which encloses a conductor (strand or wire) 13*a*-13*d*.

To connect to a matching counterpart piece the round plug connector 100 has a union nut 3, which is mounted rotatable on a contact carrier 7 made of plastic. The rear part of the contact carrier 7 is enclosed by a metallic contact sleeve 25. The four cores 11*a*, 11*b*, 11*c*, 11*d* are connected to the contact carrier 7. The four cores 11*a*-11*c* [sic] are enclosed by a shielding braid 62 and by an external cable sheath 15. The stripped end of the shielding braid 62 directly contacts a shield sleeve 60 which extends up to the contact sleeve 25. Together with the contact sleeve 25, the interior of the shield sleeve 60 forms a Faraday cage, which is filled with a potting compound 27 that is used for sealing and fixating the strands. An opening 64 is provided on the shield sleeve 60 for introducing the potting compound 27. The shield sleeve 60 and the connection cable 11 are enclosed by a grip body 14 made of plastic which extends up to the contact sleeve 25.

An O-ring 17 is provided to seal a plug connection, where said O-ring 17 prevents humidity from penetrating into the plug compartment in the connected state with a counterpart piece. The shielded round plug connector 100 is configured such that the least possible interfering radiation is absorbed and conducted to the connected device (sensor/actuator) or to the control unit (SPS) or power supply unit connected to the other end of the connection cable 11.

Figure 2:
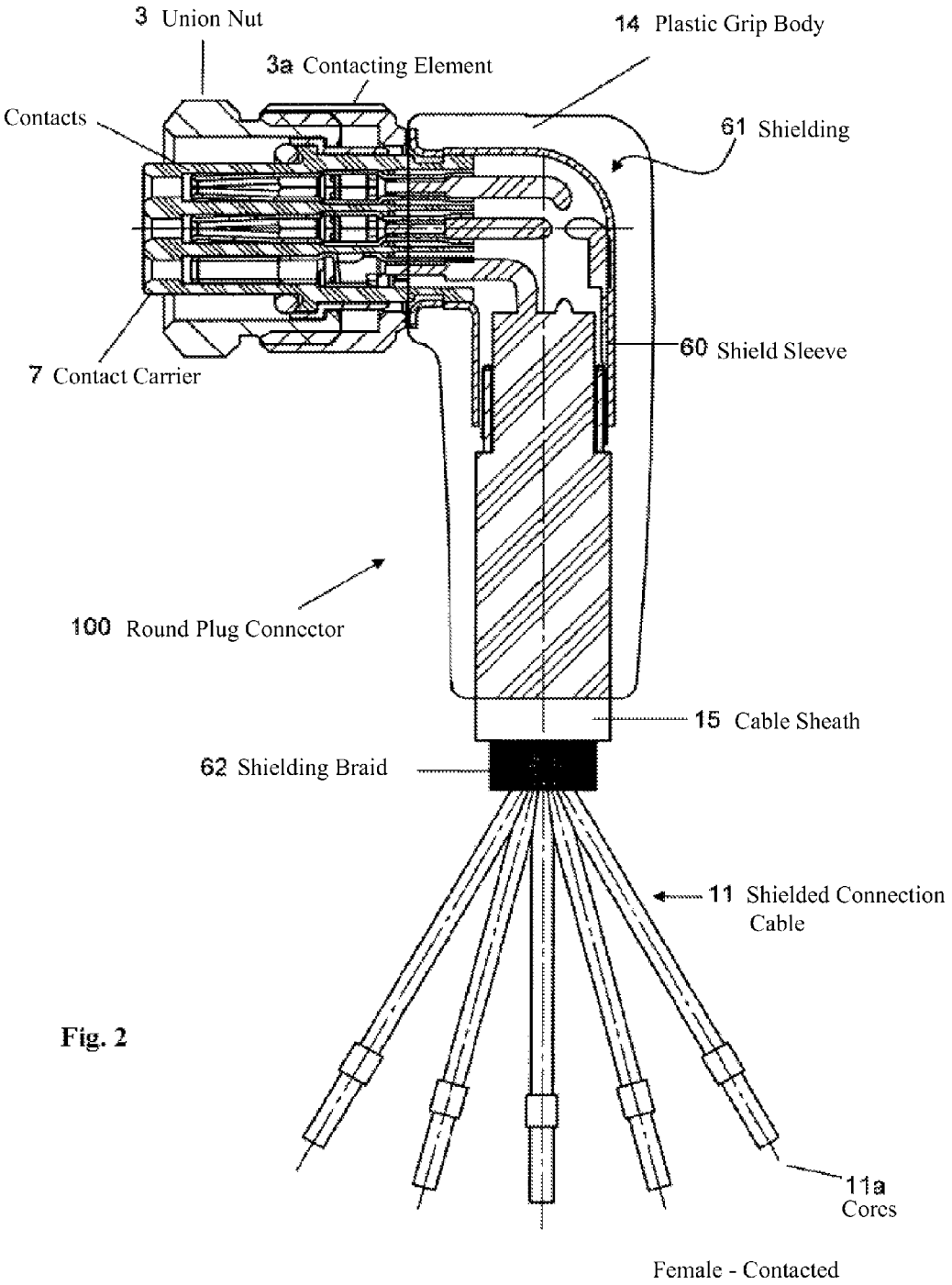
FIG. 2 depicts a cross-sectional view of an embodiment of a round plug connector (angled) with a shielded connection cable, contacting element in the "shield connected" position.

FIG. 2 shows a round plug connector according to the present invention. The basic difference relative to the round plug connector shown in FIG. 1 is that a contacting element 3*a* is additionally provided on the union nut 3, that the contact sleeve 25 has been omitted, and that the shield sleeve 60 ends at the plug side end of the grip body 14. In the interior of the round plug connector, the shielding 61 thus consists of the shield sleeve 60 and of the shielding braid 62. The contacting element 3*a* is thread-engaged (fine thread) with the union nut 3 and can be moved relatively easily toward it. In the illustrated "shield connected" case, the shield sleeve 60 is conductively connected to the contacting element 3*a*, and thus also to the union nut 3. The union nut 3 is in this case screwed tightly onto a counterpart piece which is not shown. In the screwed state of the round plug connector, only the axial position of the contacting element 3*a* can be modified.

Figure 3:
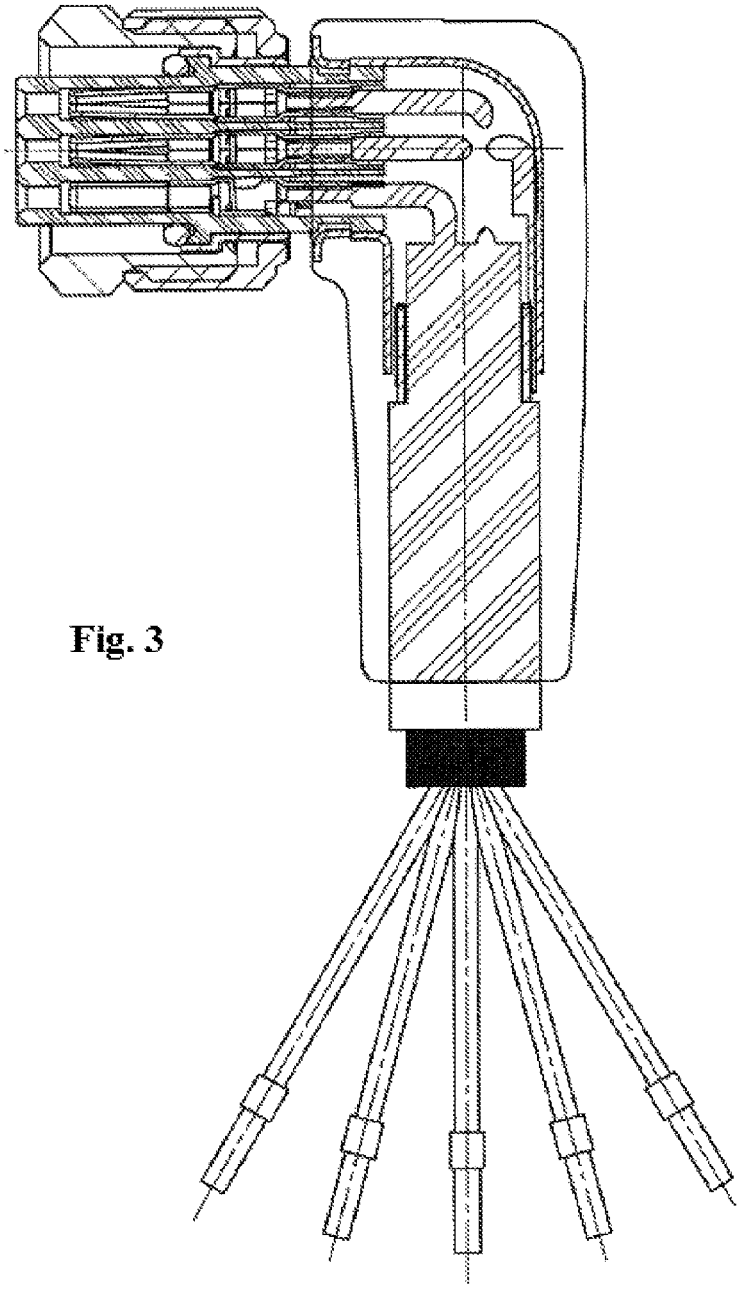
FIG. 3 depicts a cross-sectional view of an embodiment of a round plug connector according to FIG. 2, but with the contacting element in the "shield not connected" position.

FIG. 3 shows the round plug connector according to FIG. 2 in the "shield not connected" mode. In this case, the contacting element 3*a* on the union nut 3 is displaced forward so that an insulating gap appears between the contacting element 3*a* and the front end of the shield sleeve 60 which ends flush with the front edge of the grip body 14, as a result of which the electric connection between the union nut 3 and the shielding 61 is interrupted. A color mark provided on the contact carrier 7 is visible through this gap.

Figure 4:
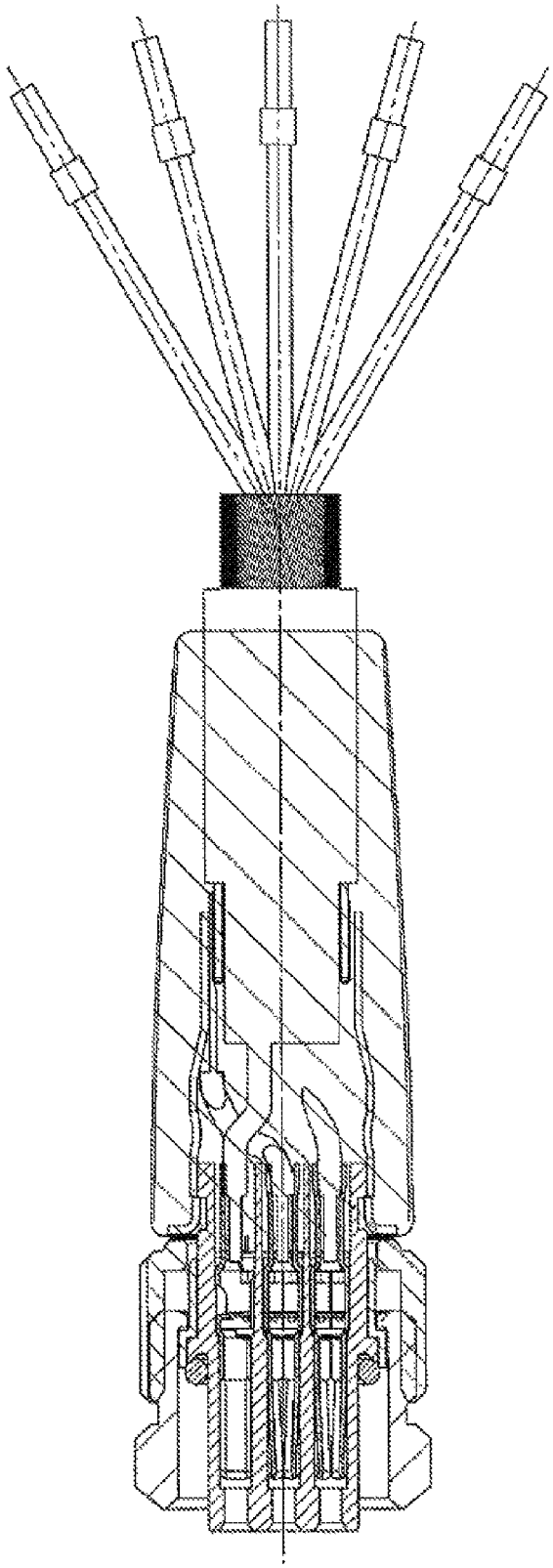
FIG. 4 depicts a cross-sectional view of an embodiment of a round plug connector of a non-angled shape with the contacting element in the position "shield connected"
Figure 5:
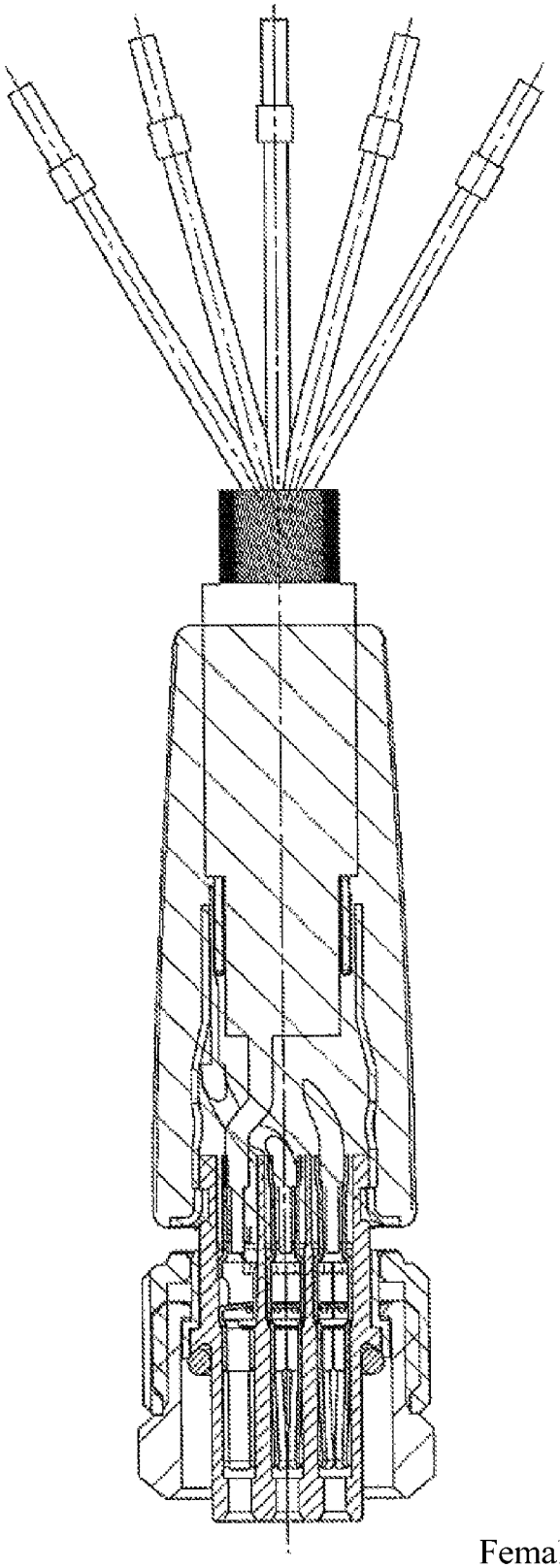
FIG. 5 depicts a cross-sectional view of an embodiment of a round plug connector of a non-angled shape with the contacting element in the position "shield not connected"

FIGS. 4 and 5 show a round plug connector according to the present invention, each in a non-angled version. Only the female version is shown for the angled 90° shape and for the non-angled shape of the round plug connector. The invention can be similarly realized in the male version of the round plug connector.

Figure 6:
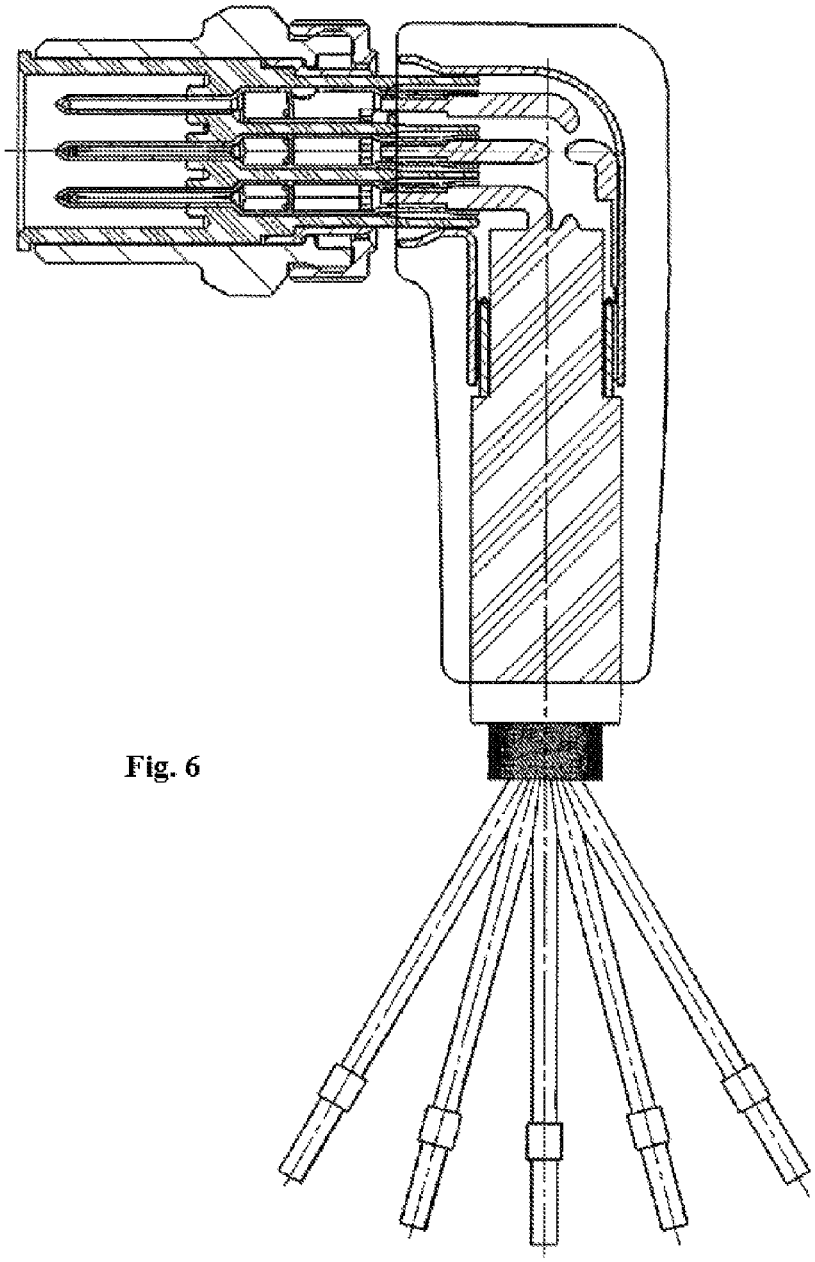
FIG. 6 depicts a cross-sectional view of an embodiment of round plug connector, angled, male version.

By way of example, FIG. 6 shows the male version with an angled shape. The basic difference relative to the female shape is that the union nut 3 is replaced as a screw element by a threaded sleeve 3*b* as a screw element, and that the contact carrier 7 is extended forward. The union nut 3 or the threaded sleeve 3*b* are each used as screw elements of a round plug connector on which the contacting element 3*a* is arranged axially movable.

Figure 7:
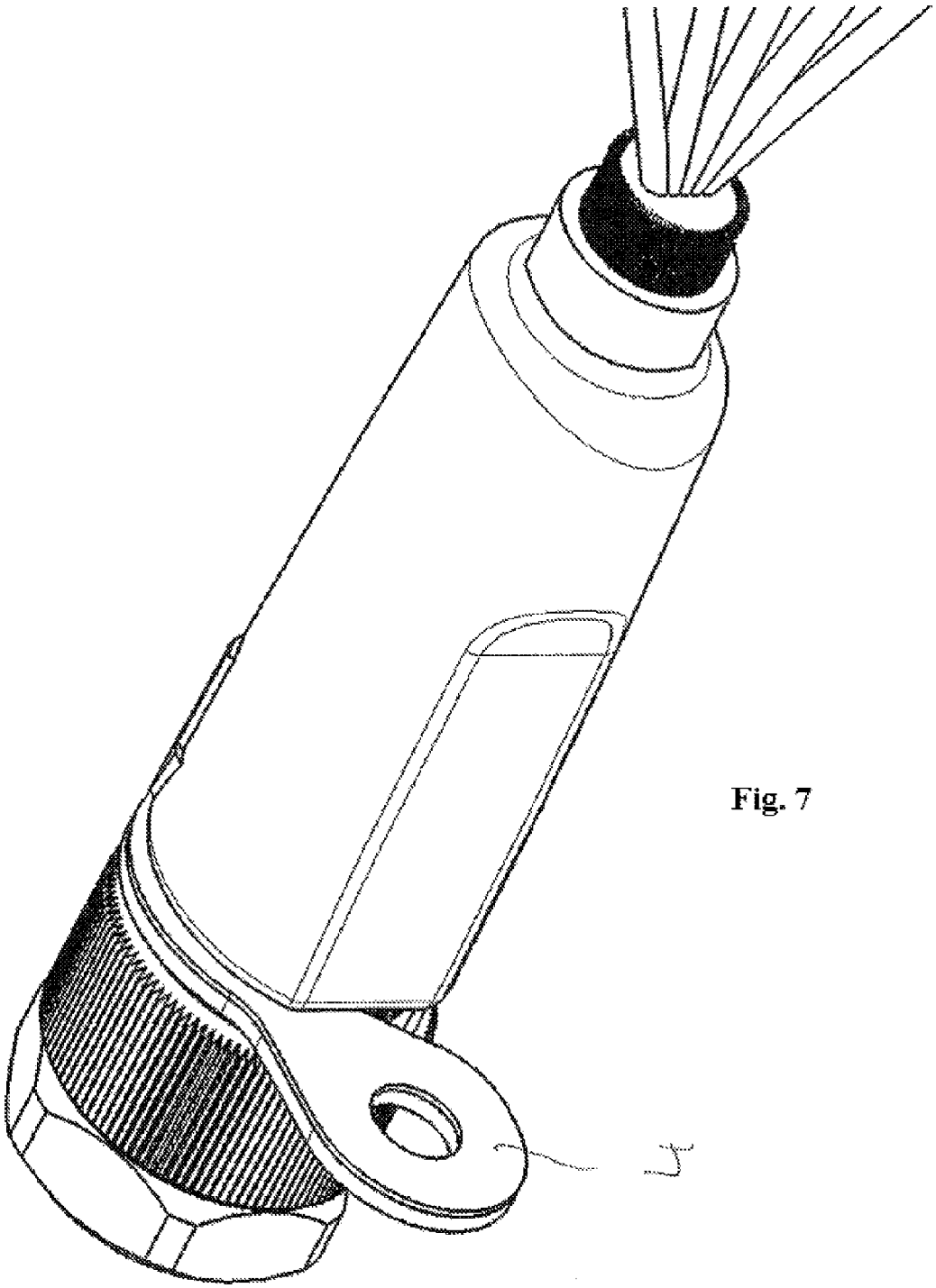
FIG. 7 depicts a perspective view of an embodiment of a round plug connector with hook element.

FIG. 7 shows another embodiment of the invention. A hook element 4 can be hooked and firmly secured to the contact carrier 7 by means of the movable contacting element 3*a*. The shielding 61 can easily be routed outward via the hook element 4 and correspondingly connected there to the reference potential. The hook element 4 can be configured fully conductive, but also only conductive on one side. As is apparent from FIG. 7, the contacting element 3*a* is knurled so that it can be actuated manually without a tool. In contrast, the union nut 3 has an external hexagon.

The function of the invention will hereinafter be explained in more detail. On operation of a system, the user can very easily choose between the two modes: "shield connected" or "shield not connected". An indication visible to the operator is preferentially affixed to the screw element, e.g. connect or disconnect, each with a symbol, e. g. a triangle showing which of both positions the screw element is actually in. In this way, the operation of a system can be easily optimized with regard to interferences. The movable contacting element 3*a* is used for this purpose. The contact element is firmly secured in both modes by screwing, so that even vibrations, such as can frequently occur in system components, cannot cause the contacting element to come loose unintentionally.

The user will immediately recognize to which round plug connector the shielding is connected, or not connected, by the color mark which is only visible in the case "shield not connected". The screw element can be configured as a union nut 3 or as a threaded sleeve 3*b*. The invention can thus be used for the male and for the female version.

Owing to the minimum space requirement, in particular, by the contacting element 3*a*, the invention can be realized for straight as well as for 90° round plug connectors. As the round plug connector according to the present invention only differs relatively little from conventional round plug connectors, it can be cost-effectively and easily manufactured.

Figure 8:
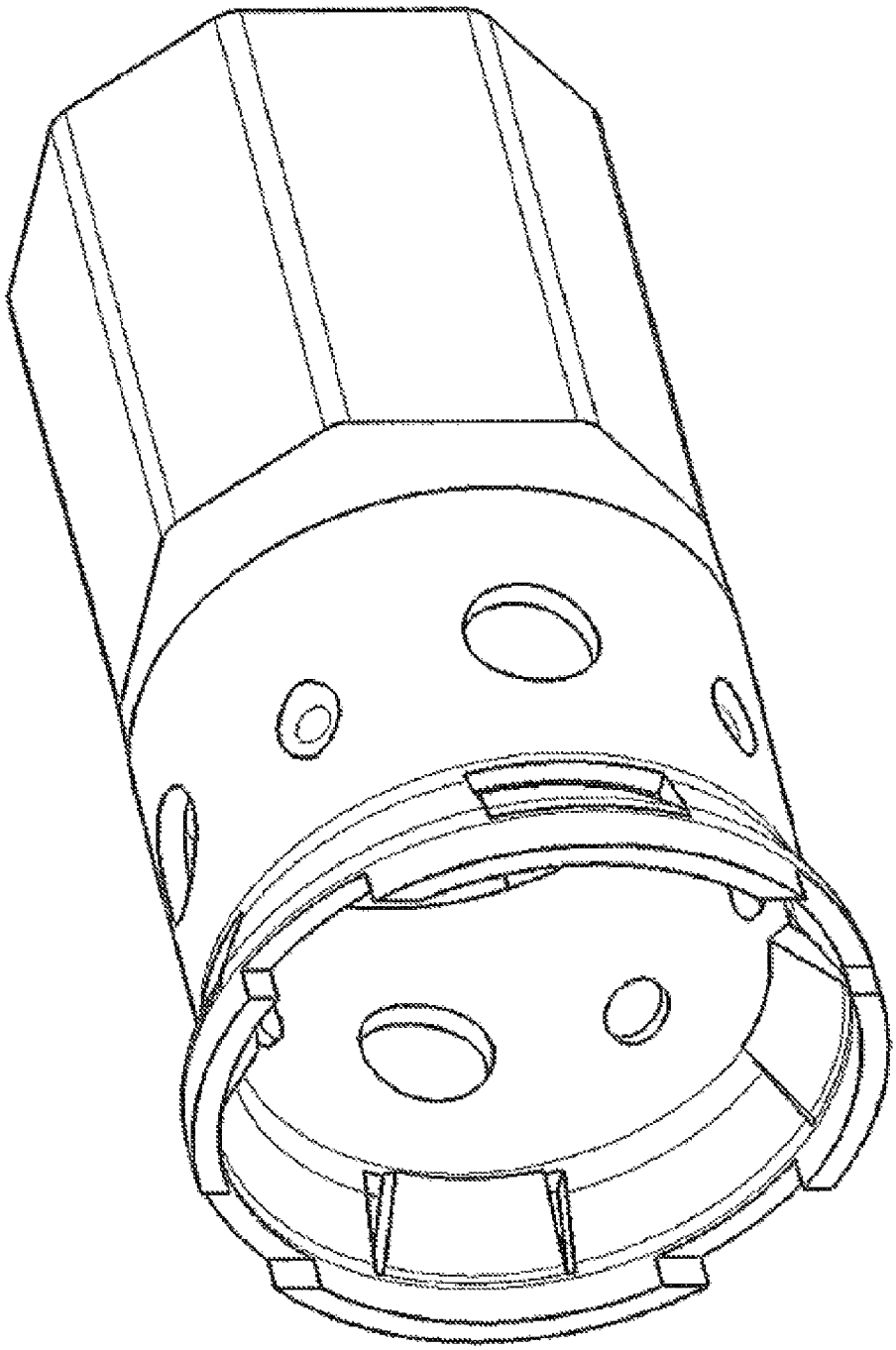
FIG. 8 depicts a perspective view of an embodiment of a shield sleeve with spring element.
Figure 9:
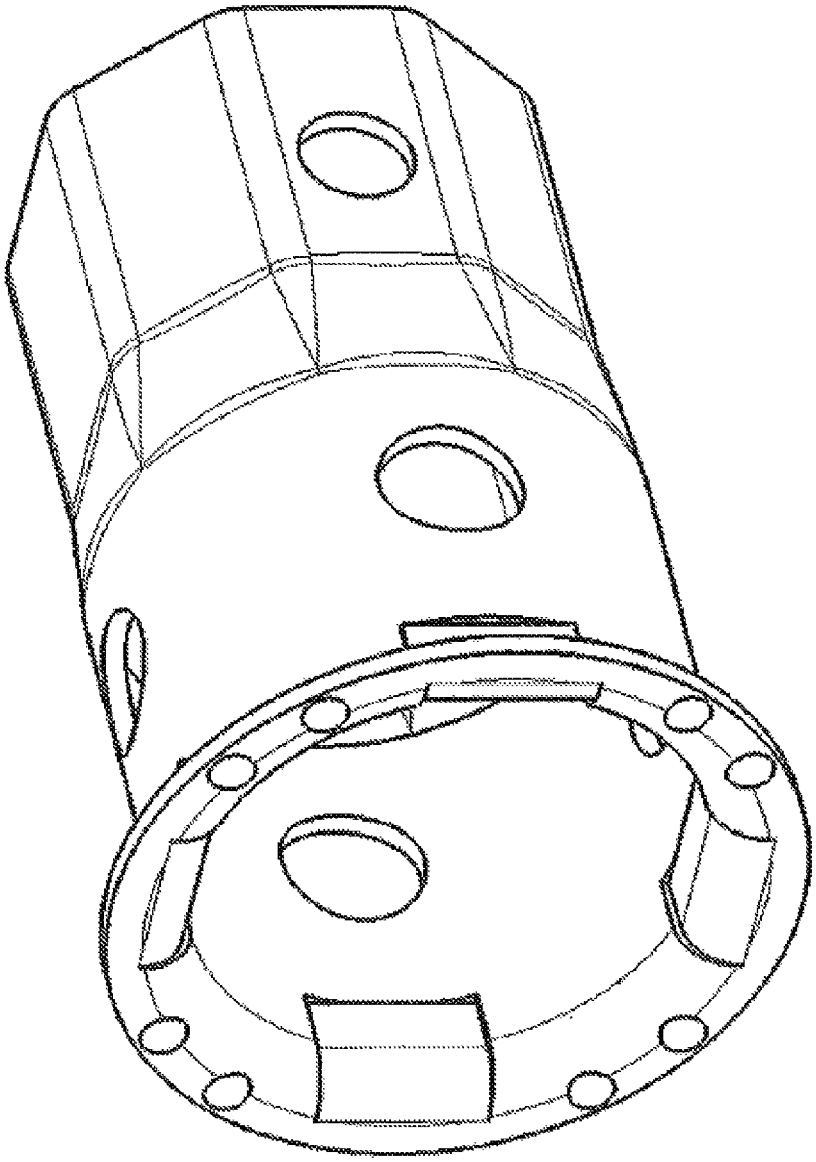
FIG. 9 depicts a perspective view of an embodiment of a shield sleeve with burls.

In a further development of the invention, the shield sleeve 60 has spring elements (FIG. 8) or burls (FIG. 9), which rest either axially or radially against the rear edge of the contacting element 3*a*. In this way, firm contacting is given even in case of a thermal relaxation.

An additional advantage is that the contacting element 3*a* cannot be lost or dismantled.

By means of the hook element 4, interferences such as can occur in wind power systems due to lightning, can be securely diverted via a separate ground connection without any damage occurring, in particular, to the sensors or actuators.

In general, the invention allows an optimization of a system with regard to external interference sources (e. g. radio equipment, high-voltage lines, powerful electric motors, etc.) and an easy adaptation to regional operational regulations or rules on shielding concepts. The invention can be easily realized in standardized round plug connectors, e.g. M12 or M8, in particular in the ecolink series from ifm electronic.

The invention claimed is:

1. A round plug connector having a shielded connection cable, with an electrically conductive screw element to be screwed to a counterpart piece, which is arranged movable on a contact carrier made of plastic, a plurality of contacts of the contact carrier being connected to a core of the shielded connection cable, with a grip body made of plastic, which encloses an end section of the shielded connection cable, an axial distance existing in a screwed state of the round plug connector between the grip body and the electrically conductive screw element, wherein the shielding ends at a plug side end of the grip body, and that an axially movable contacting element is arranged on the electrically conductive screw element, which, in the screwed state, is movable between a first, shield connected position and a second, shield not connected position, further wherein an electric connection existing in the first, shield connected position between the electrically conductive screw element and the shielding, and the electric connection being interrupted in the second, shield not connected position.

2. The round plug connector according to claim 1, wherein the axially movable contacting element is screwed onto the electrically conductive screw element.

3. A round plug connector according to claim 1, wherein a gap is visible in the second, shield not connected position between the electrically conductive screw element and the grip body, which makes a color signal visible.

4. A round plug connector according to claim 1, wherein the electrically conductive screw element is at least one of a union nut and a shield sleeve.

5. A round plug connector according to claim 1, wherein the round plug connector is an industrial M12 plug connector.

6. A round plug connector according to claim 1, wherein a shield sleeve has a plurality of spring elements at a front edge, which, in the first, shield connected position, rest against a rear edge of the axially movable contacting element.

7. A round plug connector according to claim 1, wherein a hook element is provided that is inserted into the gap between the axially movable contacting element and the grip body and secured therein.

* * * * *